US009855758B2

(12) United States Patent
Obata et al.

(10) Patent No.: US 9,855,758 B2
(45) Date of Patent: Jan. 2, 2018

(54) PRINT DEVICE

(71) Applicant: CANON KABUSHIKI KAISHA, Tokyo (JP)

(72) Inventors: Tsutomu Obata, Tokyo (JP); Noriyuki Aoki, Tokyo (JP); Shigeru Watanabe, Yokohama (JP); Toshiro Sugiyama, Yokohama (JP); Naoaki Wada, Yokohama (JP); Ryohei Maruyama, Kawasaki (JP); Ryuichi Kato, Yokohama (JP); Kouhei Tokuda, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/272,015

(22) Filed: Sep. 21, 2016

(65) Prior Publication Data

US 2017/0087851 A1 Mar. 30, 2017

(30) Foreign Application Priority Data

Sep. 30, 2015 (JP) ..... 2015-194153

(51) Int. Cl.
*B41J 2/165* (2006.01)
*B41J 2/175* (2006.01)

(52) U.S. Cl.
CPC ..... *B41J 2/17556* (2013.01); *B41J 2/1652* (2013.01); *B41J 2/16508* (2013.01); *B41J 2/16523* (2013.01); *B41J 2/16535* (2013.01); *B41J 2/16538* (2013.01); *B41J 2/17596* (2013.01)

(58) Field of Classification Search
CPC ..... B41J 2/17556; B41J 2/18596; B41J 2/16535; B41J 2/17596; B41J 2/16508; B41J 2/1652; B41J 2/16523; B41J 2/16538
USPC ..... 347/33, 85
See application file for complete search history.

(56) References Cited

U.S. PATENT DOCUMENTS

| | | | | |
|---|---|---|---|---|
| 5,329,306 | A * | 7/1994 | Carlotta | B41J 2/1721 347/90 |
| 6,168,268 | B1 | 1/2001 | Sugiyama | 347/89 |
| 8,602,513 | B2 | 12/2013 | Ara et al. | 347/7 |
| 8,678,574 | B2 | 3/2014 | Adachi | B41J 2/175 |
| 9,102,162 | B2 | 8/2015 | Watanabe et al. | B41J 2/19 |
| 2004/0061748 | A1* | 4/2004 | Kuwabara | B41J 2/17509 347/85 |

FOREIGN PATENT DOCUMENTS

| | | |
|---|---|---|
| JP | 2007-076004 | 3/2007 |
| JP | 2013-212683 | 10/2013 |

OTHER PUBLICATIONS

U.S. Appl. No. 15/266,699, filed Sep. 15, 2016.

* cited by examiner

*Primary Examiner* — Huan Tran
*Assistant Examiner* — Alexander D Shenderov
(74) *Attorney, Agent, or Firm* — Fitzpatrick, Cella, Harper & Scinto

(57) ABSTRACT

There is provided a print device including a wet liquid supply unit corresponding to a wider environmental range, with a simple and inexpensive configuration. Therefore, a valve that can change the volume is provided in a flow passage between an intermediate tank and a storing unit that stores liquid and that supplies the liquid to the intermediate tank.

17 Claims, 17 Drawing Sheets

PRINT DEVICE

BACKGROUND OF THE INVENTION

Field of the Invention

The present invention relates to a print device having a supply unit that supplies liquid stored in a liquid tank.

Description of the Related Art

A print device that ejects liquid from an ejection port and that performs printing maintains a proper ejection state by periodically cleaning (recovery processing of) a surface of the ejection port of an ejecting head that ejects the liquid. Furthermore, at the time of cleaning, a solvent (hereinafter, also referred to as wet liquid) having low volatility such as glycerin or polyethylene glycol is caused to adhere to a wiper (cleaning member) that wipes the surface of the ejection port, and the wiper also wipes the surface of the ejection port.

In addition, Japanese Patent Laid-Open No. 2007-076004 proposes a recovery device that prevents the hygroscopicity of wet liquid or the leakage of the wet liquid due to change in attitude of a print device, with a simple and inexpensive configuration.

However, the wet liquid sent out of the tank is exposed to an external environment, and thus the wet liquid may be influenced by an environmental change. In particular, the wet liquid having high viscosity at low temperature has large loss of pressure in a case where the wet liquid is moved from the tank, and thus cannot be moved.

SUMMARY OF THE INVENTION

Accordingly, in the present invention, there is provided a print device having a wet liquid supply unit corresponding to a wider environmental range, by a simple and inexpensive configuration.

Therefore, the print device according to the present invention includes: a first liquid storing unit that can store liquid; a second liquid storing unit that can store the liquid supplied from the first liquid storing unit via a liquid flow passage and can supply air to the first liquid storing unit via an air flow passage; a reverse-flow suppressing unit that suppresses a flow of the liquid from the second liquid storing unit to the first liquid storing unit in the liquid flow passage; an air flow passage valve that is provided in the air flow passage and can shut off the air flow passage; and a pressurizing unit that can pressurize the liquid in the first liquid storing unit in a state where the air flow passage is shut off by the air flow passage valve.

According to the present invention, it is possible to realize a print device having a wet liquid supply unit corresponding to a wider environmental range, by a simple and inexpensive configuration.

Further features of the present invention will become apparent from the following description of exemplary embodiments (with reference to the attached drawings).

DESCRIPTION OF THE EMBODIMENTS (First Embodiment)

Figure 1:
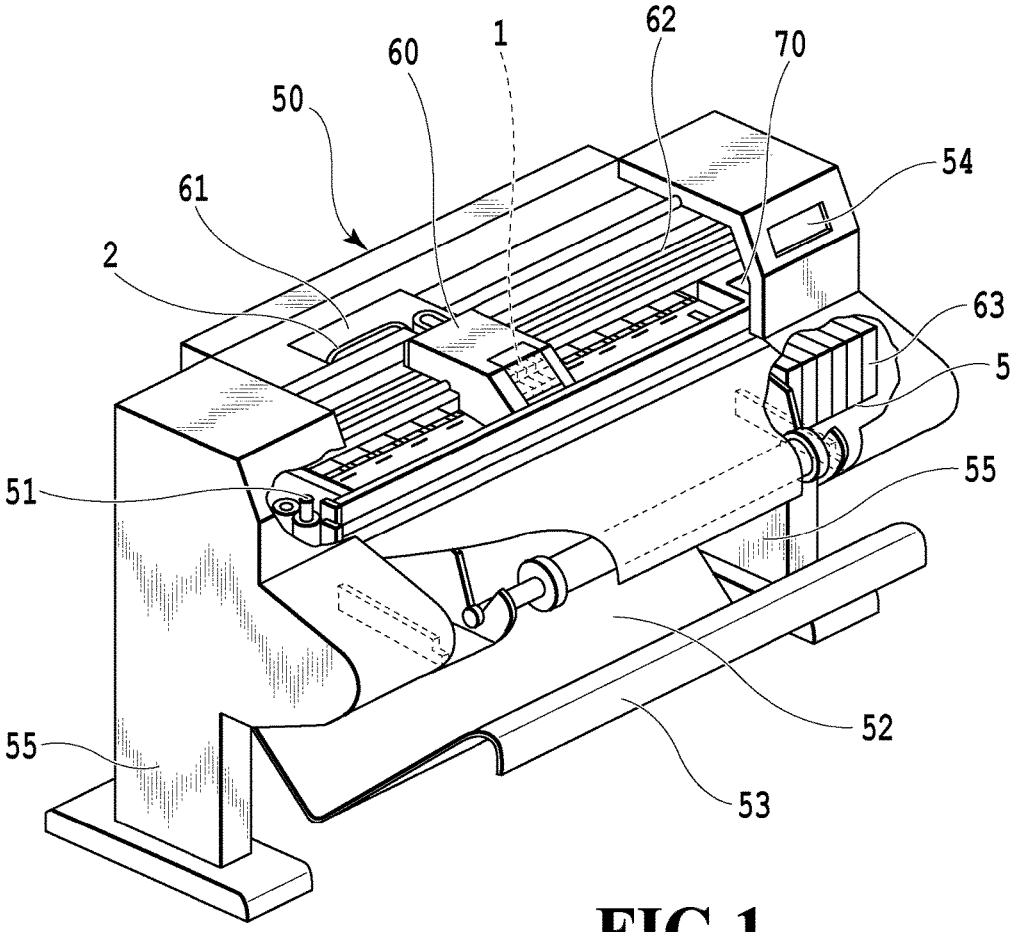
FIG. 1 is a perspective view showing a print device.

Hereinafter, a description of a first embodiment of the present invention will be given with reference to the drawings. Note that the same reference numeral denotes the same or corresponding part in the respective drawings.

FIG. 1 is a perspective view showing a print device to which the present embodiment can be applied. A print device 50 is fixed so as to stride over two leg portions 55. The print device 50 includes a carriage, and a print head 1 that ejects liquid from an ejection port is mounted on the carriage 60. At print time, a print medium set to a conveyance roll holder unit 52 is fed to a print position, and the carriage 60 ejects the liquid to the print medium by using a carriage motor (not shown) and a belt transmitting unit 62 while being reciprocated in a main scanning direction shown by an arrow B.

In a case where the carriage 60 is moved to one end of the print medium, a conveyance roller 51 conveys the print medium in a sub-scanning direction shown by an arrow A by a predetermined amount. As mentioned above, an image is formed on the whole print medium by alternately repeating the print operation by the print head 1 and the conveyance operation by the conveyance roller 51. After forming the image, the print medium is cut with a cutter (not shown) and the cut print medium is mounted on a stacker 53.

A liquid supply unit 63 includes liquid tanks 5 that are detachable to the device and are separated for colors such as black, cyan, magenta, and yellow. Each liquid tank 5 is connected to a supply tube 2, and supplies and receives the liquid to/from the carriage 60 via the supply tube 2. Furthermore, the supply tube 2 connected to the carriage 60 is bent and moved corresponding to reciprocating movement of the carriage 60.

An array (ejection port array) of a plurality of ejection ports is provided on a surface (surface of the ejection port) facing the print medium in the print head 1 in a direction substantially perpendicular to the main scanning direction and is connected to the supply tube 2 in the unit of the ejection port arrays. Furthermore, a recovery device 70 is provided outside the range of the print medium range in the main scanning direction and at a position facing the surface of the ejection port of the print head 1.

Figure 2:
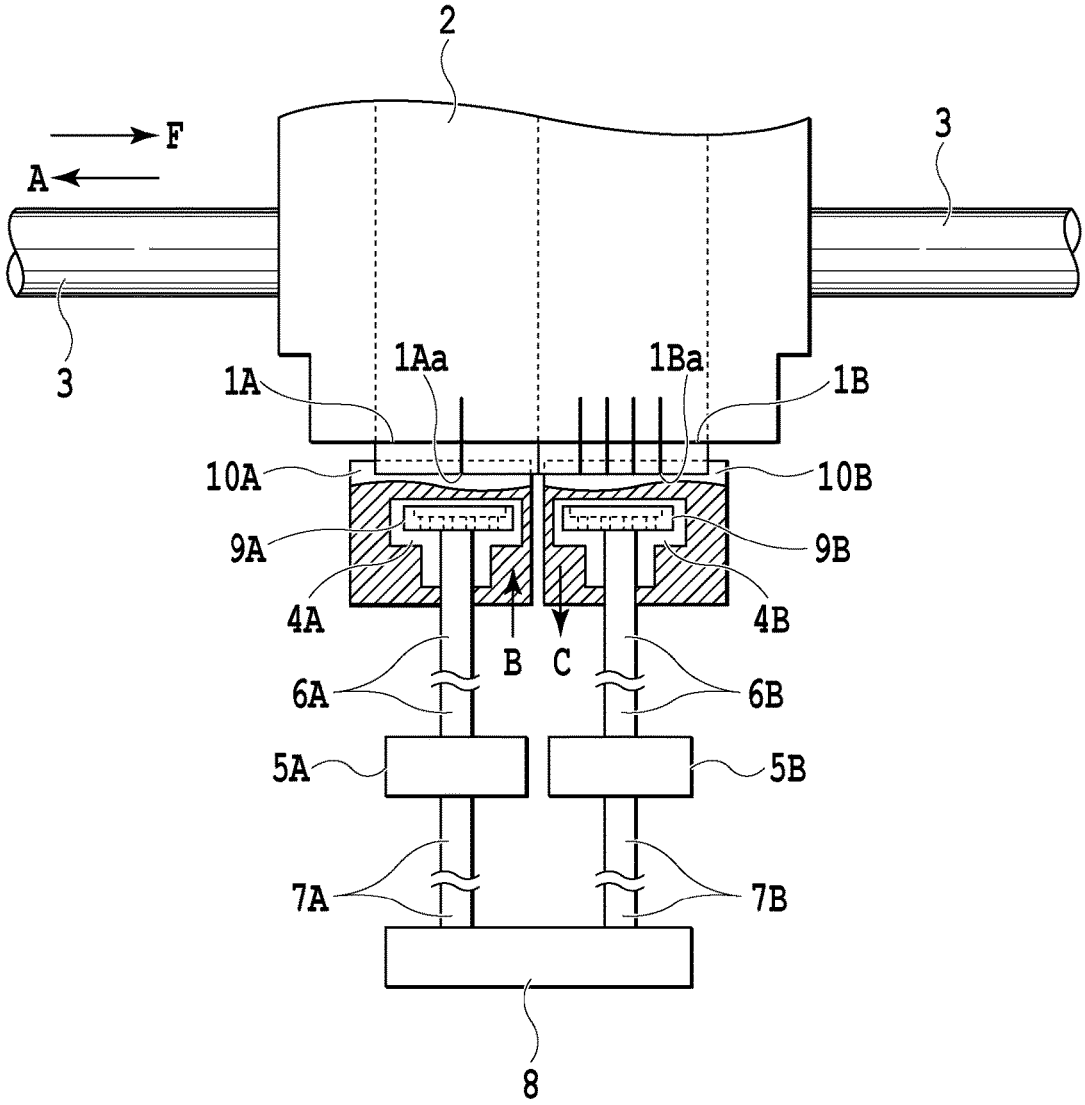
FIG. 2 is a diagram showing a recovery device included in the print device.

FIG. 2 is a diagram showing the recovery device 70 included in the print device 50. The recovery device 70 includes a suction recovery mechanism that performs a suction recovery operation of the print head 1, and a cleaning mechanism that removes (can wipe), with the wiper, the liquid adhering to the surface of the ejection port of the print head 1. Between these, the suction recovery mechanism includes capping units having caps 4A and 4B made of rubber elastic members that adhere to the surfaces of the ejection ports of print heads 1A and 1B and that can shield the ejection ports. Moreover, the suction recovery mechanism includes the caps 4A and 4B, suction pumps 5A and 5B connected to the caps 4A and 4B via tubes 6A and 6B, and a waste ink processing member 8 connected to the suction pumps 5A and 5B via second tubes 7A and 7B.

At the time of the suction recovery operation, negative pressure is generated in a caps 4A and 4B by using the pumps 5A and 5B in a state where the caps 4A and 4B are caused to adhere (a state of being capped), respectively, to the surfaces of the ejection ports of the respective print heads. Foreign substances such as ink adhering to the ejection port by using the negative pressure, thickening ink, air bubbles, fixed ink, and dusts are sucked and are discharged to the waste ink processing member 8. Note that the suction recovery operation is executed in consideration of necessity, just before starting the printing, every predetermined print time or every print operation during the printing, or in a case where it is detected that the recovery processing of the print head is required.

Figure 3:
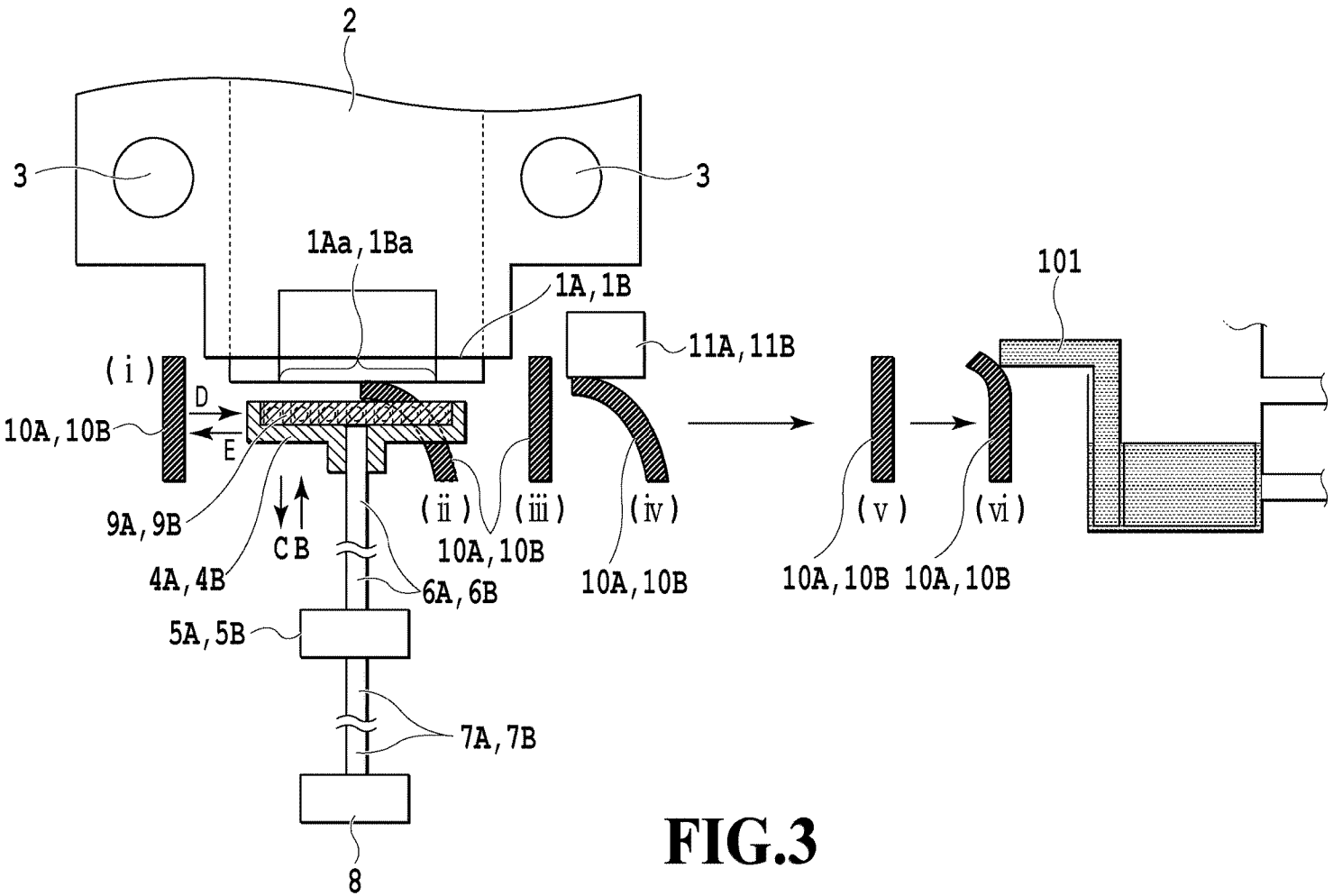
FIG. 3 is a diagram showing the recovery device included in the print device.

FIG. 3 is a diagram showing the recovery device 70 included in the print device 50. A cleaning mechanism of the recovery device 70 includes a wiper mechanism that scrapes out (wipes) the foreign substances such as liquid or dusts adhering to the respective surfaces of the ejection ports of the print heads 1A and 1B. The wiper mechanism includes wipers 10A and 10B slidable to the respective print heads, and moving units moving the wipers 10A and 10B in the direction perpendicular to the main-scanning direction. Furthermore, the wipers 10A and 10B can suck the liquid, and the cleaning mechanism includes a wet liquid supply mechanism that can supply, to the wipers 10A and 10B, wet liquid (processing liquid) for reducing the change in wetness property of the surfaces of the ejection ports. The wet liquid supply mechanism supplies the wet liquid to the wipers 10A and 10B by bringing the wet liquid transfer member 101 into contact with the wipers 10A and 10B.

Figure 4:
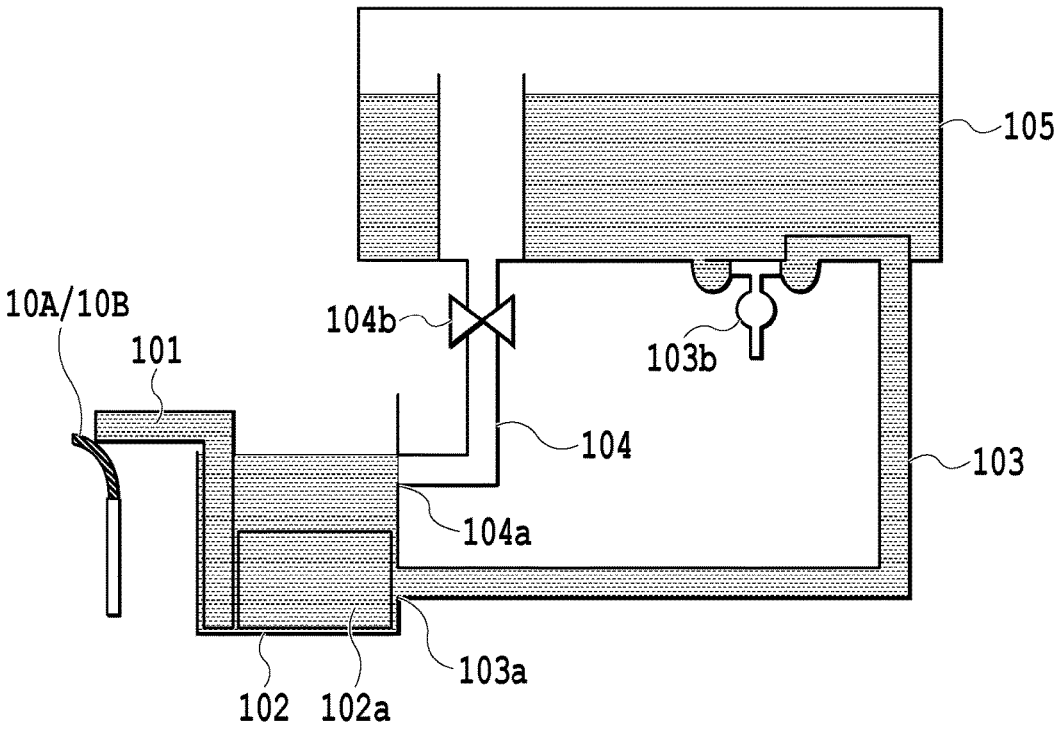
FIG. 4 is a longitudinal side-view showing a wet liquid supply mechanism.

FIG. 4 is a longitudinal side-view showing the wet liquid supply mechanism according to the present embodiment. Herein, a description will be given of a configuration and an operation of the wet liquid supply mechanism. First, a description will be given of a configuration for supplying the wet liquid from a first processing liquid storing unit 102 (intermediate tank) to the wipers 10A and 10B. The first processing liquid storing unit 102 includes a wet liquid transfer member 101, and the wet liquid is transferred to the wipers 10A and 10B and is then supplied by bringing the wipers 10A and 10B into contact with a part of the wet liquid transfer member 101. The wet liquid transfer member 101 is formed of a porous body having air permeability, and can hold the wet liquid by the porous body. Furthermore, the first processing liquid storing unit (liquid storing unit) 102 includes a wet liquid holding member (liquid holding member) 102*a* that can hold the liquid so as to be adjacent to a wet liquid supply passage coupling unit (connecting unit) 103*a*.

Next, a description will be given of a configuration for replenishing the wet liquid to the first processing liquid storing unit 102 from the second processing liquid storing unit 105 that stores (can store) the wet liquid. The second processing liquid storing unit 105 is connected to a wet liquid flow passage 103 that is coupled to the wet liquid supply passage coupling unit 103*a* in the first processing liquid storing unit 102 and supplies the wet liquid, and is connected to an air flow passage 104 that is coupled to an air flow passage coupling unit 104*a* in the first processing liquid storing unit 102 and that introduces air. The wet liquid flow passage 103 includes a wet liquid flow passage valve 103*b* (pressurizing unit) that can shut off the flow passage, and the air flow passage 104 includes an air flow passage valve 104*b* that can shut off the flow passage.

The valves provided in both of the flow passages maintain a closing state in a case where the wet liquid is not supplied. The wet liquid flow passage valve 103*b* can change the volume while housing the liquid in addition to including a valve function, and can temporarily stores the wet liquid therein. At the time of supplying the wet liquid, the wet liquid flow passage valve 103*b* changes the volume along with the opening/closing operation of the valve by using a driving system which will be described later, and supplies the wet liquid from the second processing liquid storing unit 105 to the first processing liquid storing unit 102. Referring to FIG. 4, the air flow passage coupling unit 104*a* is arranged above the first processing liquid storing unit 102, and the wet liquid supply passage coupling unit 103*a* is arranged under the first processing liquid storing unit 102. However, the present invention is not limited to this. The wet liquid supply passage coupling unit 103*a* may be arranged so as to have the same height as that of the air flow passage coupling unit 104*a*, or may be arranged above the air flow passage coupling unit 104*a*.

Figure 5:
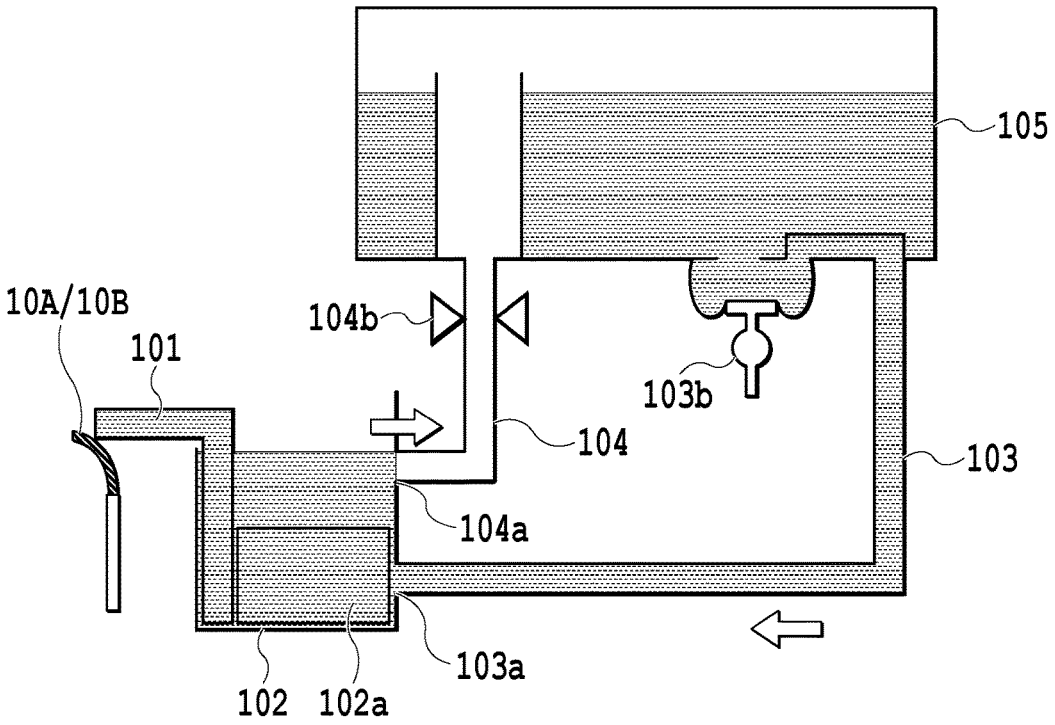
FIG. 5 is a diagram showing a first processing liquid storing unit and a second processing liquid storing unit.

FIG. 5 is a diagram showing the first processing liquid storing unit 102 with arrangement of the air flow passage coupling unit 104*a* above the wet liquid supply passage coupling unit 103*a*, and the second processing liquid storing unit 105. In a case where the air flow passage coupling unit 104*a* is arranged above the wet liquid supply passage coupling unit 103*a*, the second processing liquid storing unit 105 is arranged above the first processing liquid storing unit 102. With the configuration as mentioned above, it becomes possible, by opening both of the valves 103*b* and 104*b*, to supply the wet liquid to the first processing liquid storing unit 102 from the second processing liquid storing unit 105, due to a water head difference. The supply of the wet liquid automatically stops in a case where the air flow passage valve 104*b* is covered with the wet liquid. Furthermore, in a case where the wet liquid supply passage coupling unit 103*a* is arranged above the air flow passage coupling unit 104*a*, the supply of the wet liquid by a the water head difference does not become possible because of an arrangement relationship. However, the wet liquid is supplied by forced conveyance thereof by using the wet liquid flow passage valve 103*b* that can change the volume and the wet liquid holding member. Subsequently, a description of a configuration is given in a case where the air flow passage coupling unit 104*a* is arranged above the wet liquid supply passage coupling unit 103*a*.

Figure 6A:
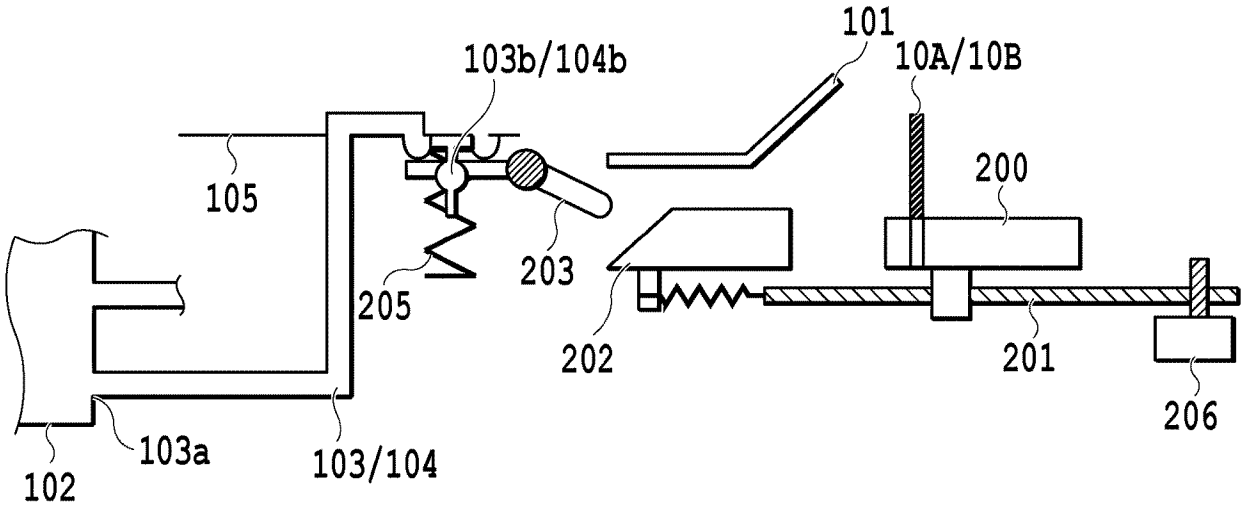
FIG. 6A is a diagram showing an operational mechanism of a wet liquid flow passage valve and wipers.
Figure 6B:
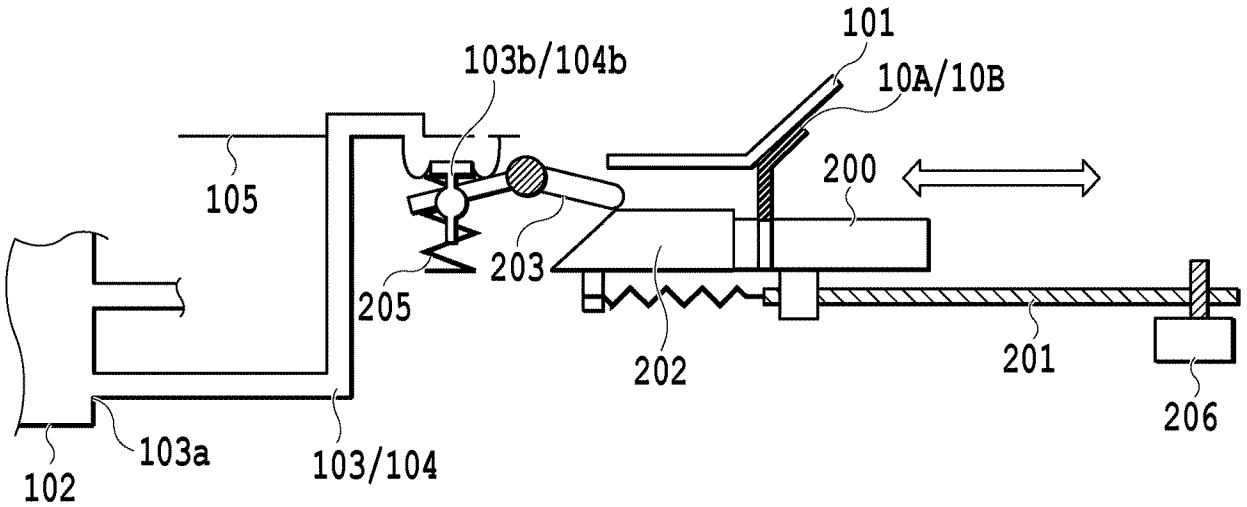
FIG. 6B is a diagram showing the operational mechanism of the wet liquid flow passage valve and the wipers.

FIGS. 6A and 6B are diagrams showing operational mechanisms of the wet liquid flow passage valve 103*b* and the wipers. FIG. 6A shows a closing state of the wet liquid flow passage valve 103*b*, and a configuration in which the wet liquid flow passage valve 103*b* shuts off the wet liquid flow passage (liquid flow passage) 103 by using a valve spring 205. Furthermore, the wet liquid flow passage valve 103*b* and the air flow passage valve 104*b* are configured to be almost simultaneously operated, and in a case where the wet liquid flow passage 103 is shut off, the air flow passage 104 is also simultaneously shut off. FIG. 6B shows an opening state of the wet liquid flow passage valve 103*b*. The wet liquid flow passage valve 103*b* performs the opening/closing operation in conjunction with operations of the wipers 10A and 10B.

The wipers 10A and 10B are held to the wiper holding member 200, and the wiper holding member 200 is reciprocated in an arrow direction by driving a motor 206 and rotating a lead screw 201 via a gear. In a case where the wiper holding member 200 is moved and comes into contact with a shaft 202 as shown in FIG. 6B, the shaft 202 is pressed and is moved by the wiper holding member 200, thereby rotating a valve opening member 203. Along with rotation of the valve opening member 203, the wet liquid flow passage valve 103*b* (and the air flow passage valve 104*b*) are opened. At this time, the wipers 10A and 10B come into contact with the wet liquid transfer member 101, thereby transferring and supplying the wet liquid. The wet liquid flow passage valve 103*b* is configured to change the volume by the opening/closing operation, and the volume is increased by the opening of the valve and is reduced by the closing of the valve.

Figure 7A:
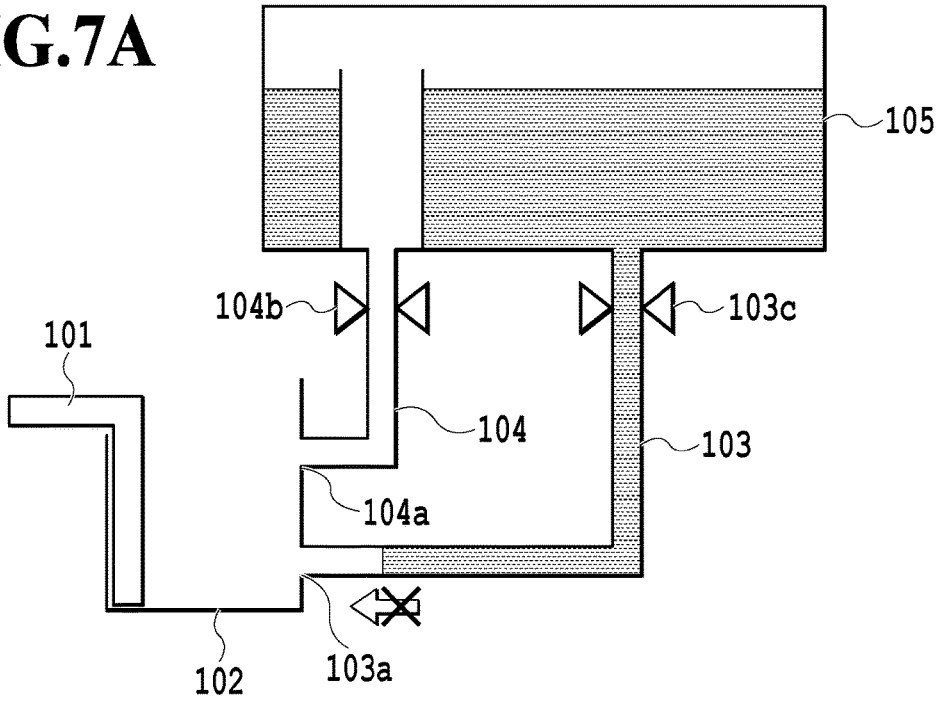
FIG. 7A is a diagram showing the first processing liquid storing unit and the second processing liquid storing unit.
Figure 7B:
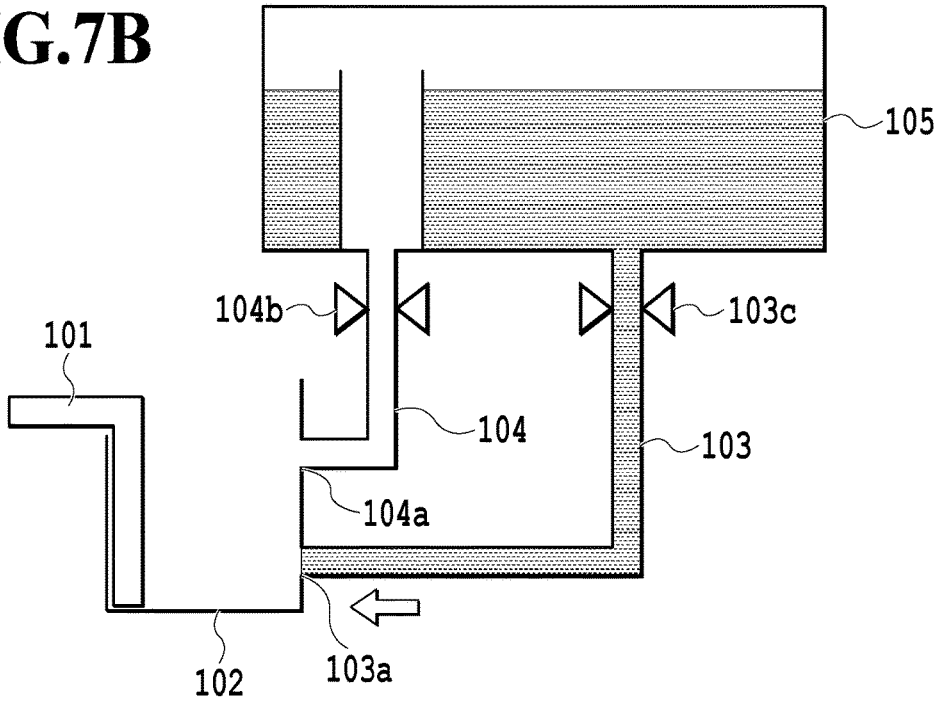
FIG. 7B is a diagram showing the first processing liquid storing unit and the second processing liquid storing unit.

FIGS. 7A and 7B are diagrams showing the second processing liquid storing unit 105 that supplies the wet liquid to the first processing liquid storing unit 102. The first processing liquid storing unit 102 does not have the wet liquid holding member, and the wet liquid flow passage valve 103*c* does not change the volume. Here, a description of a behavior of the wet liquid at the time of the supply is given in the configurations of the first and second processing liquid storing units shown in FIGS. 7A and 7B. As shown in FIG. 7B, in a case of opening the wet liquid flow passage valve 103*c*, the wet liquid having low viscosity is supplied by a water head difference because of a positional relationship between the first processing liquid storing unit 102 and the second processing liquid storing unit 105. However, in a case where the viscosity of the wet liquid becomes high, as shown in FIG. 7A, the pressure loss of the wet liquid is increased in the wet liquid flow passage 103, and the wet liquid stops in the middle of the wet liquid flow passage 103, without being supplied to the first processing liquid storing unit 102.

Figure 8A:
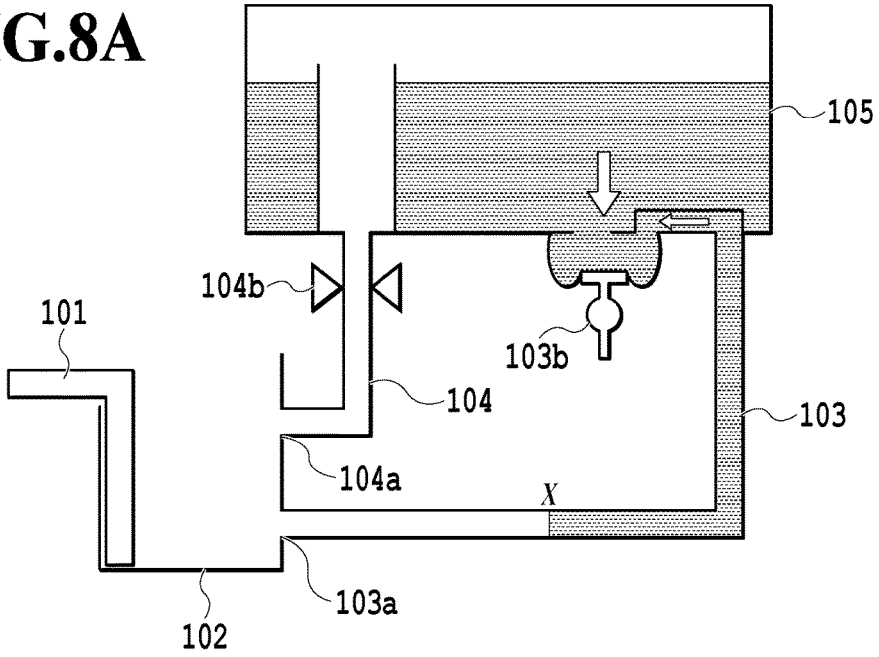
FIG. 8A is a diagram showing the first processing liquid storing unit and the second processing liquid storing unit.
Figure 8B:
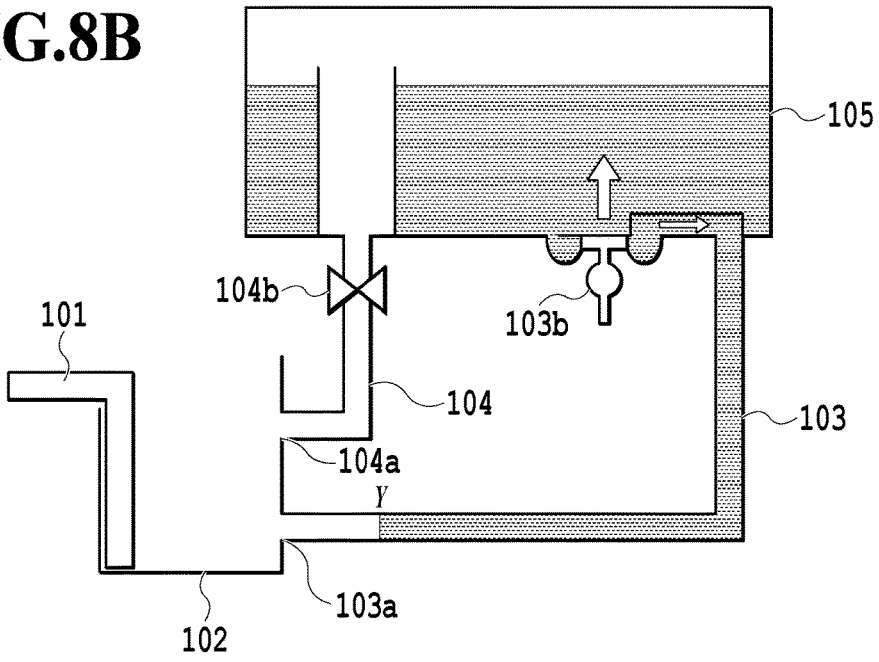
FIG. 8B is a diagram showing the first processing liquid storing unit and the second processing liquid storing unit.

FIGS. 8A and 8B are diagrams showing the second processing liquid storing unit 105 that supplies the wet liquid to the first processing liquid storing unit 102. The first processing liquid storing unit 102 does not have a wet liquid holding member, and the volume is changed with the wet liquid flow passage valve 103*c*. Here, a description will be given of a behavior of the wet liquid at the time of supply, in the configurations of the first and second processing liquid storing units shown in FIGS. 8A and 8B. First, as shown in FIG. 8A, in a case where the wet liquid flow passage valve 103*b* enlarges the volume, the wet liquid having high viscosity is pulled inside the valve from both the second processing liquid storing unit 105 and the first processing liquid storing unit 102. At this time, X denotes a position on the liquid surface of the wet liquid in the wet liquid flow passage 103. Next, as shown in FIG. 8B, in a case where the wet liquid flow passage valve 103*b* reduces the volume, the wet liquid in the valve is pressed to both the second processing liquid storing unit 105 and the first processing liquid storing unit 102. At this time, Y denotes a position on the liquid surface of the wet liquid in the wet liquid flow passage 103.

As mentioned above, in the configurations of the first processing liquid storing unit 102 and the second processing liquid storing unit 105 as shown in FIGS. 8A and 8B, even in a case where the wet liquid flow passage valve 103*b* enlarges or reduces the volume, the positions X and Y on the liquid surface are only alternatively moved and the wet liquid is not supplied to the first processing liquid storing unit 102.

Figure 9A:
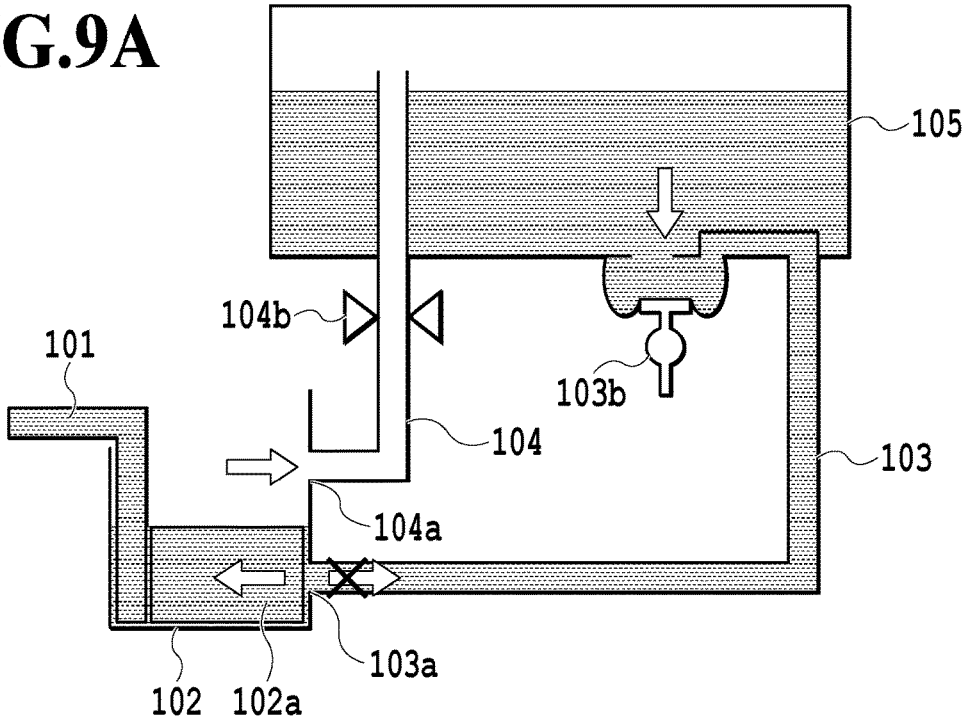
FIG. 9A is a diagram showing the first processing liquid storing unit and the second processing liquid storing unit.
Figure 9B:
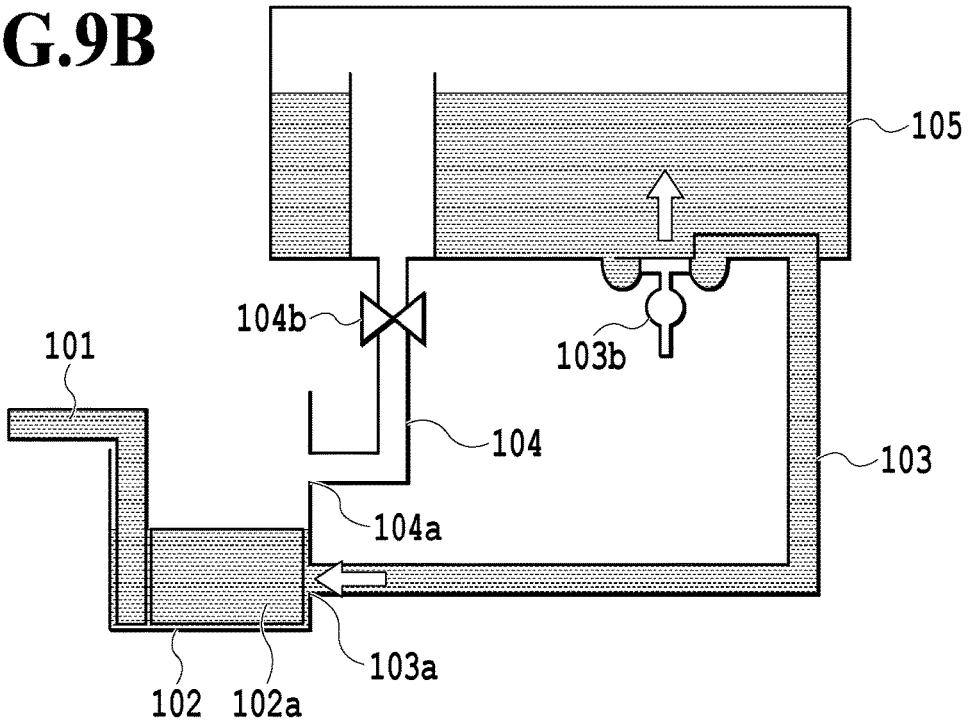
FIG. 9B is a diagram showing the first processing liquid storing unit and the second processing liquid storing unit.

FIGS. 9A and 9B are diagrams showing the second processing liquid storing unit 105 that supplies the wet liquid to the first processing liquid storing unit 102. The first processing liquid storing unit 102 includes a wet liquid holding member, and the wet liquid flow passage valve 103*c* changes the volume. According to the present embodiment, the first processing liquid storing unit 102 and the second processing liquid storing unit 105 include configurations shown in FIGS. 9A and 9B. Here, a description will be given of the behavior of the wet liquid at the time of supplying the wet liquid in the configurations of the first and second processing liquid storing units shown in FIGS. 9A and 9B. In a case where the wet liquid flow passage valve 103*b* enlarges the volume as shown in FIG. 9A, the wet liquid is pulled in from both the first and second processing liquid storing units.

However, holding force of the liquid by the wet liquid holding member (reverse-flow suppressing member) 102*a* arranged near the wet liquid supply coupling unit 103*a* in the first processing liquid storing unit 102 becomes resistance, and thus the wet liquid pulled from the first processing liquid storing unit 102 side is not pulled in. The wet liquid holding member 102*a* functions as a member for suppressing the reverse flow, and only the wet liquid from the second processing liquid storing unit 105 side having low resistance is pulled inside wet liquid flow passage valve 103*b*. Then, the wet liquid in the second processing liquid storing unit 105 is moved to the wet liquid flow passage 103, and thus air is introduced from the air flow passage coupling unit 104*a* via the air flow passage 104. At this time, the wet liquid holding member 102*a* is arranged apart from the air flow passage coupling unit 104*a*, and thus the air is easily pulled in with low resistance.

Subsequently, as shown in FIG. 9B, in a case where the volume of the wet liquid flow passage valve 103*b* is reduced, the wet liquid moved inside the valve at the time of volume enlargement is pushed out to both the first processing liquid storing unit 102 and the second processing liquid storing unit 105. In a case where the wet liquid is pushed out inside the wet liquid flow passage valve 103*b*, the holding force of the liquid by the wet liquid holding member 102*a* does not work, and thus the wet liquid is pushed out to both the first processing liquid storing unit 102 and the second processing liquid storing unit 105. As mentioned above, it is possible to supply the wet liquid in the second processing liquid storing unit 105 to the first processing liquid storing unit 102 by a pumping effect of the wet liquid flow passage valve 103*b*, by repeating the opening/closing operation of the wet liquid flow passage valve 103*b*.

Figure 10A:
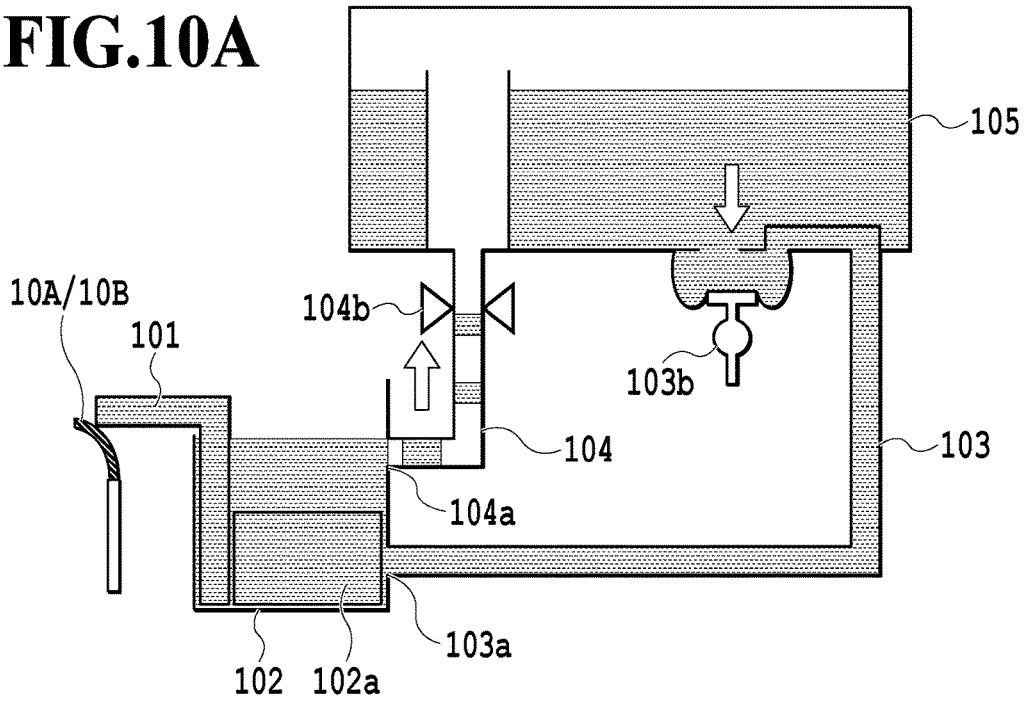
FIG. 10A is a diagram showing the first processing liquid storing unit and the second processing liquid storing unit.
Figure 10B:
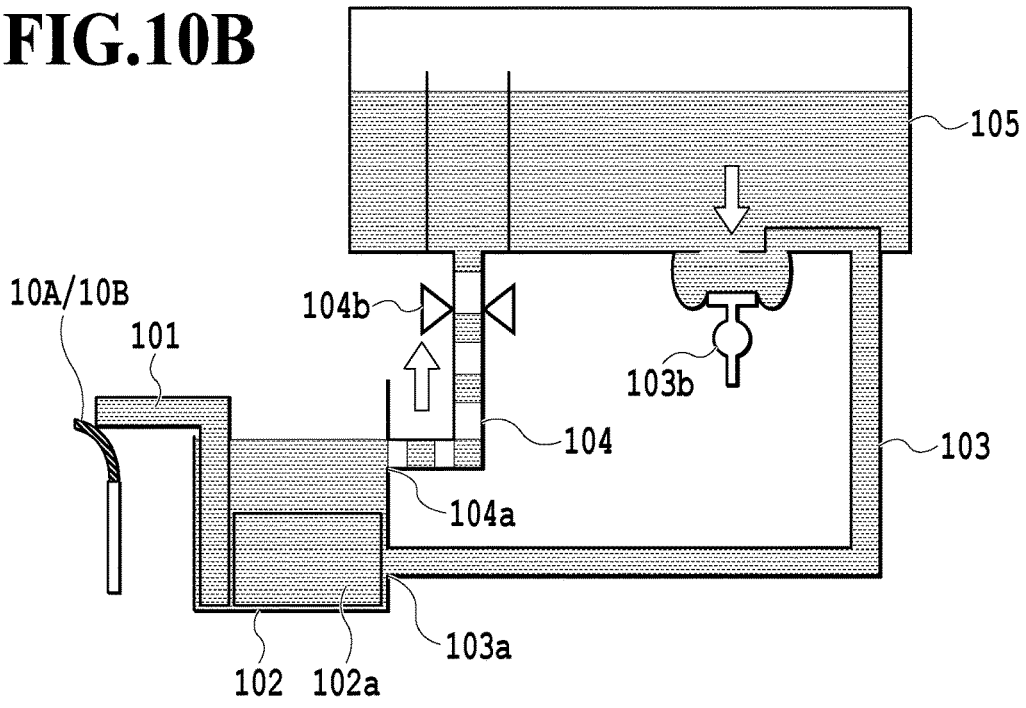
FIG. 10B is a diagram showing the first processing liquid storing unit and the second processing liquid storing unit.

FIGS. 10A and 10B are diagrams showing the second processing liquid storing unit 105 that supplies the wet liquid to the first processing liquid storing unit 102. In a case where the wet liquid is gradually consumed, by the wipers 10A and 10B, from the first processing liquid storing unit 102 via the wet liquid transfer member 101, the amount of supply from the second processing liquid storing unit 105 is increased and the amount of supply may be larger than the amount of consumption. In this case, as shown in FIG. 10A, in a case where the liquid surface inside the first processing liquid storing unit 102 rises and reaches the air flow passage coupling unit 104*a*, an inside of the air flow passage 104 is brought into a striping state where the wet liquid and the air are alternatively introduced as shown in FIGS. 10A and 10B.

Furthermore, after sufficient passage of time, as shown in FIG. 10B, the amount of the wet liquid in the air flow passage 104 is brought into a state of being increased. As mentioned above, the wet liquid enters the air flow passage 104 and the wet liquid serves as resistance in a case of introducing the air. However, since the change in volume of the wet liquid flow passage valve 103*b* is substantially large, the air introduction is carried out from the air flow passage 104, and he wet liquid is supplied to the first processing liquid storing unit 102 from the second processing liquid storing unit 105.

Note that the wet liquid holding member 102*a* mentioned here includes sponge-like polypropylene fibers (hereinafter, referred to as PP sponge). As shown in FIGS. 9A and 9B, in a case where the wet liquid transfer member 101 and the wet liquid holding member 102*a* are arranged in contact with each other, the wet liquid holding member 102*a* is required to have capillary force lower than that of the wet liquid transfer member 101 in order to ensure the absorption of the wet liquid by the wet liquid transfer member 101. Therefore, the average pore diameter, the apparent density of the wet liquid holding member 102*a* and the like may be properly selected so as to maintain the above-mentioned relationship of the capillary force.

(Modification)

Figure 11:
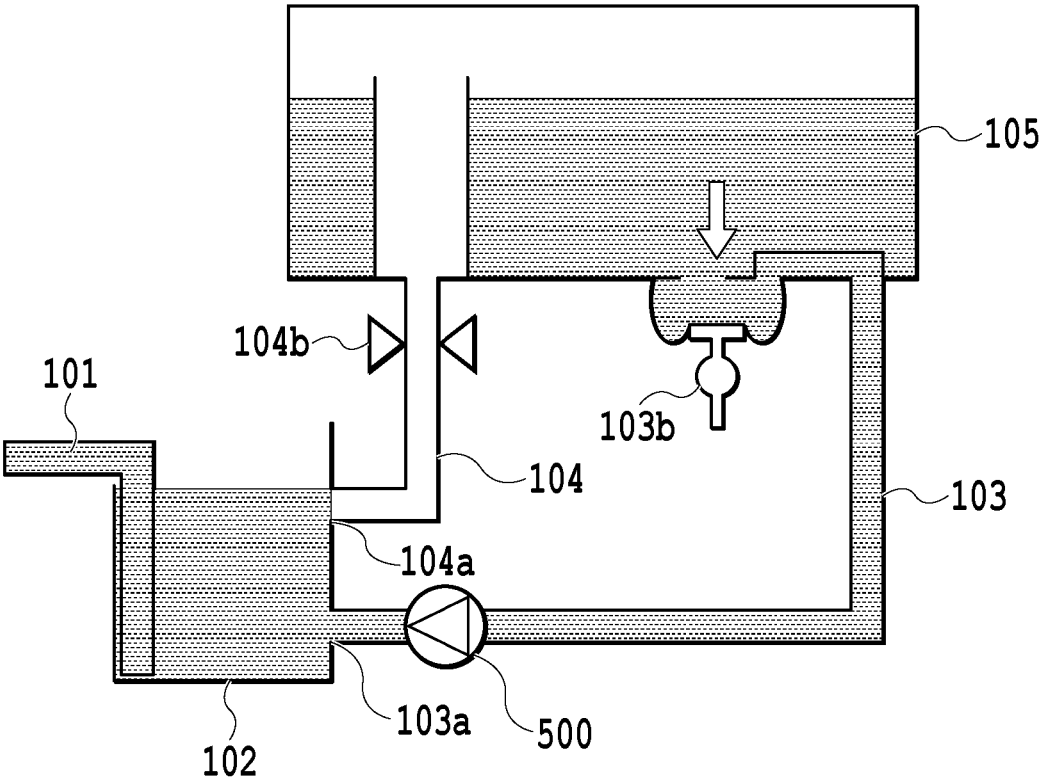
FIG. 11 is a diagram showing a modification.

FIG. 11 is a diagram showing a modification of the present embodiment. In place of the wet liquid holding member 102*a*, there may be provided a one-directional valve 500 for preventing the reverse flow of the wet liquid in the wet liquid flow passage 103 as shown in FIG. 11.

Note that, according to the present embodiment, the wet liquid has been supplied to the first processing liquid storing unit from the second processing liquid storing unit through the use of the wet liquid flow passage valve that can change the volume, but the present invention is not limited to this, and the wet liquid may be supplied through the use of an inexpensive pump or the like.

As mentioned above, the valve that can change the volume is provided in the flow passage between the intermediate tank and the storing unit that stores the liquid and that supplies the liquid to the intermediate tank. Accordingly, it is possible to realize the print device including the wet liquid supply unit corresponding to a wider environmental range, with a simple and inexpensive configuration.

(Second Embodiment)

Hereinafter, there will be given a description of a second embodiment of the present invention with reference to the drawings. Note that, since the basic configuration according to the present embodiment is similar to that according to the first embodiment, only a characteristic configuration will be described below.

Figure 12A:
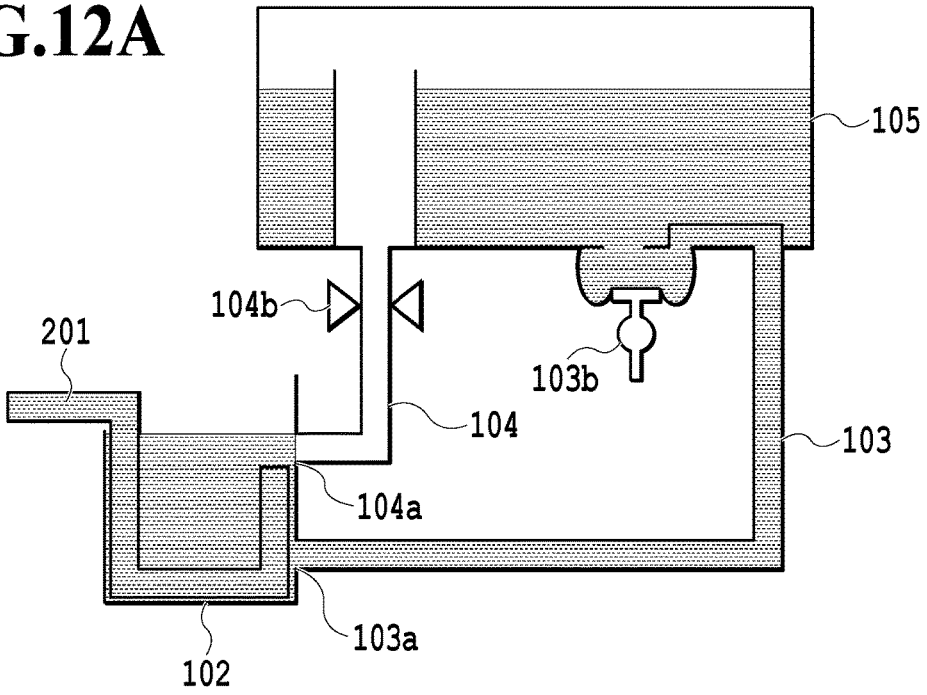
FIG. 12A is a diagram showing the first processing liquid storing unit and the second processing liquid storing unit.
Figure 12B:
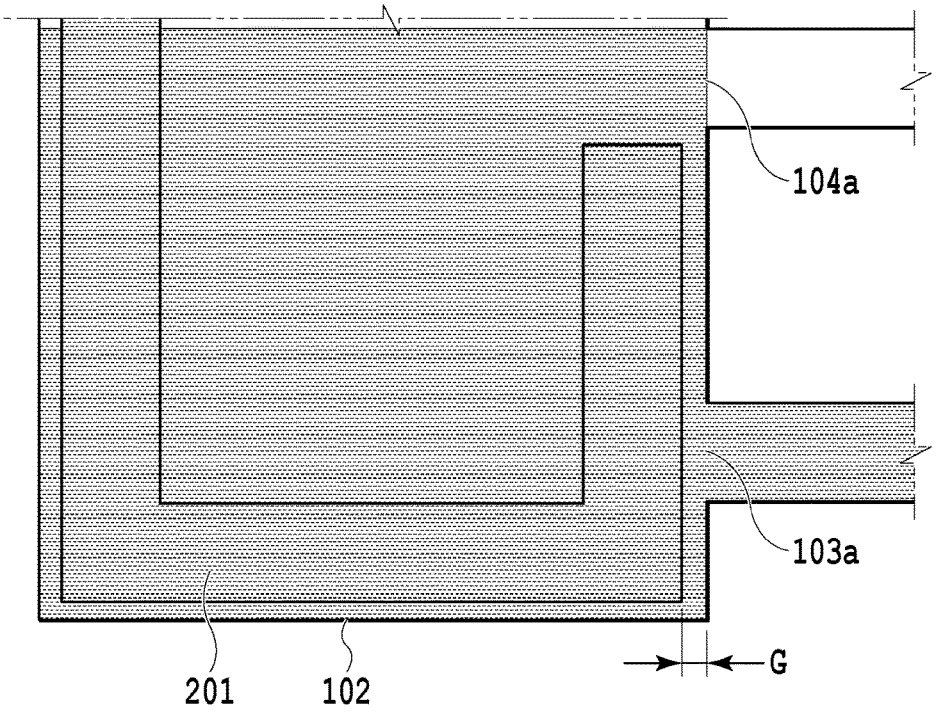
FIG. 12B is a diagram showing the first processing liquid storing unit and the second processing liquid storing unit.

FIGS. 12A and 12B are diagrams showing a first processing liquid storing unit 102 and a second processing liquid storing unit 105 according to the present embodiment. According to the present embodiment, a part of the wet liquid transfer member 201 is configured to be used as a substitute for the function of the wet liquid holding member 102*a*. The part of the wet liquid transfer member 201 according to the present embodiment is adjacent to the wet liquid supply passage coupling unit 103*a*, is formed apart from the air flow passage coupling unit 104*a*, and is arranged in the first processing liquid storing unit 102. The supply mechanism can supply even the wet liquid having high viscosity by substituting a part of the wet liquid transfer member 201 for the function of the wet liquid holding member 102*a* according to the first embodiment.

FIG. 12B is an enlarged view showing the vicinity of the wet liquid supply passage coupling unit 103*a*. Flow resistance is generated by making a distance G between the wet liquid transfer member 201 and the wet liquid supply passage coupling unit 103*a* close to approximately 0 to 1 mm, thereby exhibiting a function of a member for suppressing the reverse flow at the time of pulling-in by the wet liquid flow passage valve 103*b*.

As mentioned above, the valve that can change the volume is provided between the intermediate tank and the storing unit that stores the wet liquid and that supplies the wet liquid to the intermediate tank. Resistance in pulling-in by the wet liquid flow passage valve 103*b* is generated by a part of the wet liquid transfer member 201. Accordingly, it is possible to realize the print device having the wet liquid supply unit corresponding to a wider environmental range, with a simple and inexpensive configuration.

(Third Embodiment)

Hereinafter, there will be given a description of a third embodiment of the present invention with reference to the drawings. Note that, since the basic configuration according to the present embodiment is similar to that according to the first embodiment, only a characteristic configuration will be described below. According to the present embodiment, in a case where the viscosity of the wet liquid becomes high at low temperature, the wet liquid is supplied by changing the opening/closing operation timing of the valve by using the configuration according to the first embodiment.

Figure 13A:
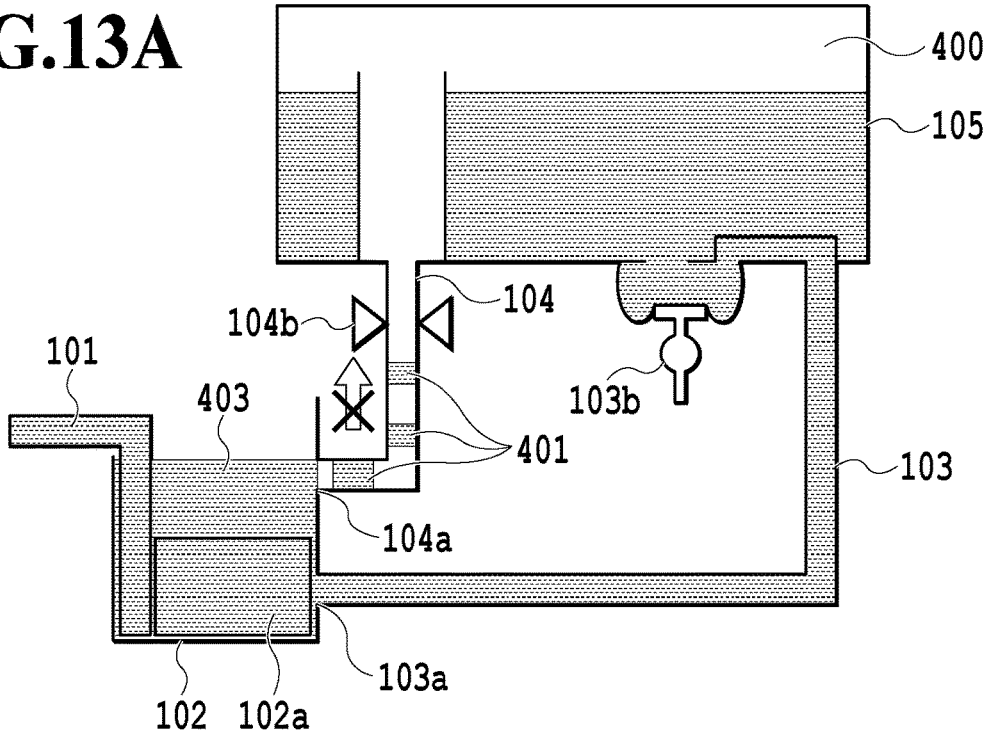
FIG. 13A is a diagram showing the first processing liquid storing unit and the second processing liquid storing unit.
Figure 13B:
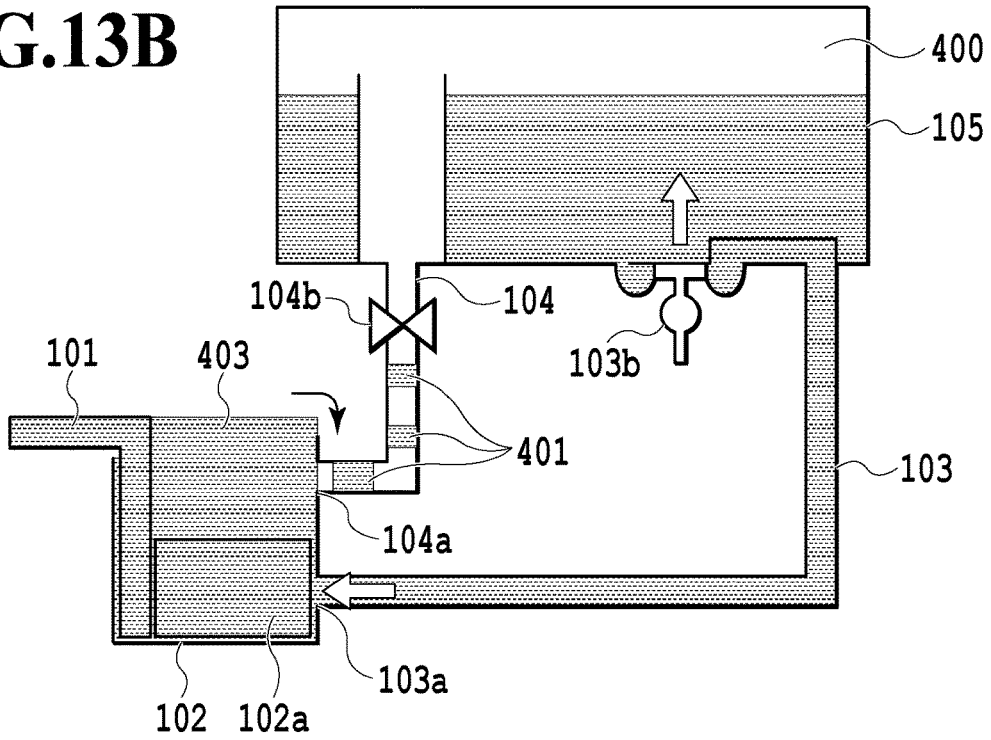
FIG. 13B is a diagram showing the first processing liquid storing unit and the second processing liquid storing unit.

FIGS. 13A and 13B are diagrams showing a state where the viscosity of the wet liquid becomes high at low temperature by the configuration according to the first embodiment. Even in the state of low temperature, the wet liquid in the second processing liquid storing unit 105 can be supplied to the first processing liquid storing unit 102 due to the pumping effect of the wet liquid flow passage valve 103*b*. However, in a case where the viscosity of wet liquid 401 in the air flow passage 104 becomes high, the air sometimes cannot be introduced into a space 400.

Namely, in a case where the viscosity of the wet liquid 401 in the air flow passage 104 is high and the pressure loss is increased, as shown in FIG. 13A, the wet liquid 401 in the air flow passage 104 is not moved and shuts off the air flow passage 104, and the air cannot be introduced into the space 400. In this case, since the air is not introduced into the space 400 via the air flow passage 104, negative pressure is brought into a state of being maintained in the space 400 in a case where the wet liquid flow passage valve 103*b* is opened to enlarge the volume.

In a case where the viscosity of the wet liquid is low, the air having the same volume as that of the wet liquid flown out from the second processing liquid storing unit 105 by the valve flows into the space 400 of the second processing liquid storing unit 105 via the air flow passage 104. Furthermore, the wet liquid that is increased too much in the first processing liquid storing unit 102 is also returned to the second processing liquid storing unit 105 through the air flow passage 104. Therefore, a water surface 403 of the first processing liquid storing unit 102 is usually maintained so as to be almost the same height as that of the air flow passage coupling unit 104*a*. However, in a case where the viscosity of the wet liquid becomes high and the flow of the air flow passage 104 is shut off, the air does not flow into the second processing liquid storing unit 105, and thus the supply to the first processing liquid storing unit 102 becomes excessive. As a result, as shown in FIG. 13B, in a case where the water surface 403 in the first processing liquid storing unit 102 is increased and is over a wall of a container of the first processing liquid storing unit 102, the wet liquid is leaked outside.

Accordingly, in the present embodiment, the wet liquid is prevented from leaking out from the first processing liquid storing unit 102, depending on the opening/closing timing of the valve. Hereinafter, a description will be given of a supply method of maintaining the water level at a stable position without leakage of the wet liquid from the first processing liquid storing unit 102 even in a case where the viscosity of the wet liquid becomes high at low temperature.

Figure 14A:
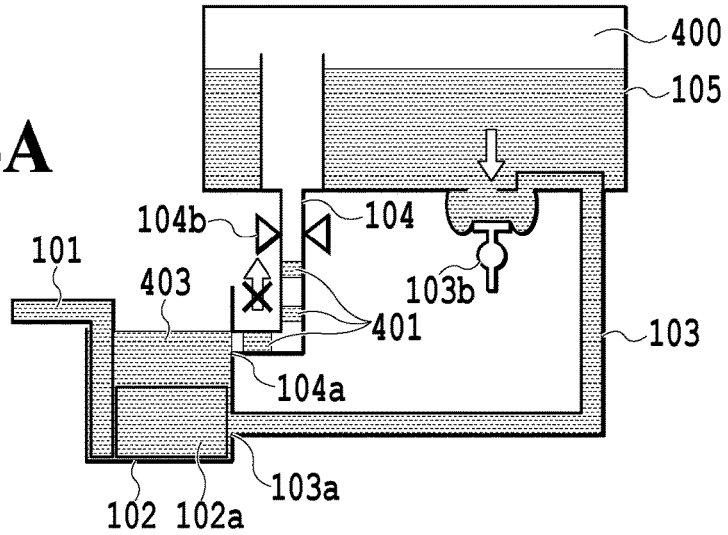
FIG. 14A is a diagram showing the first processing liquid storing unit and the second processing liquid storing unit.
Figure 14B:
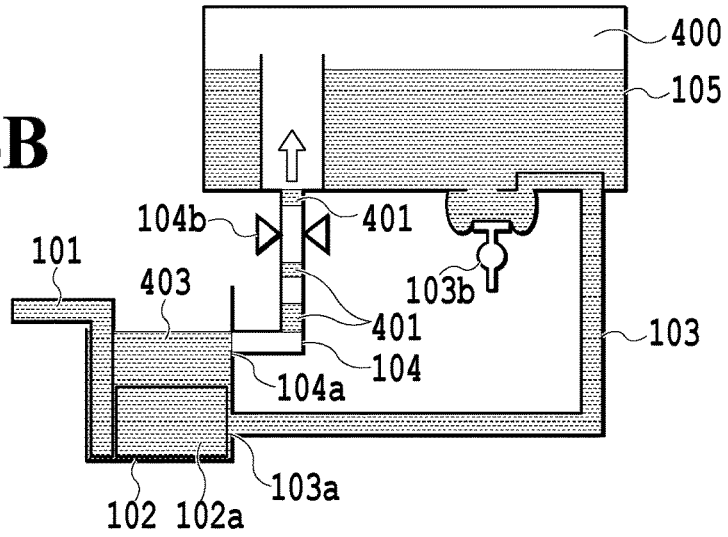
FIG. 14B is a diagram showing the first processing liquid storing unit and the second processing liquid storing unit.
Figure 14C:
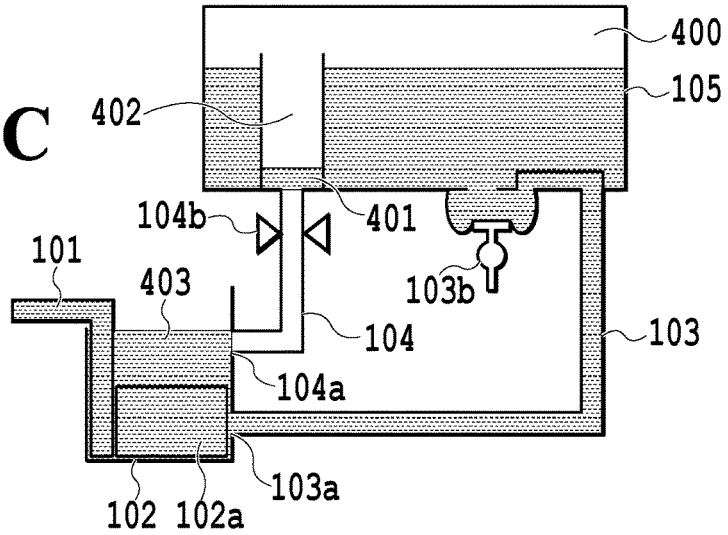
FIG. 14C is a diagram showing the first processing liquid storing unit and the second processing liquid storing unit.

FIGS. 14A to 14C are diagrams showing the first processing liquid storing unit 102 and the second processing liquid storing unit 105 according to the present embodiment. FIG. 14A shows a state where the wet liquid flow passage valve 103*b* is opened and the air cannot be guided with high viscosity of the wet liquid 401 and increase of pressure loss. FIG. 14B shows an opening state of the wet liquid flow passage valve 103*b* in a case where the state is maintained for a predetermined time. Negative pressure of the space 400 starts to gradually move the wet liquid having high viscosity in the air flow passage 104, and the negative pressure of the space 400 in the second processing liquid storing unit 105 is gradually released. The time until the negative pressure of the space 400 is released is different depending on the temperature or the like at that time.

FIG. 14C shows an opening state of the wet liquid flow passage valve 103*b* in a case of being maintained from the state in FIG. 14B. In this state, the wet liquid 401 in the air flow passage 104 is moved to a space 402 having a cross-sectional shape capable of carrying out gas-liquid exchange and formed in the second processing liquid storing unit 105, and thus the air can be introduced into the space 400 via the air flow passage 104. The negative pressure of the space 400 is reset by introduction of the air into the space 400. As mentioned above, since the operation is waited for a predetermined time after opening the valve, the air having the same volume as that of the wet liquid flowing out from the second processing liquid storing unit 105 flows in. Thereby, the balance between the flow-in and flow-out has been achieved, and thus the water surface 403 in the first processing liquid storing unit 102 is maintained at a stable position.

Figure 15:
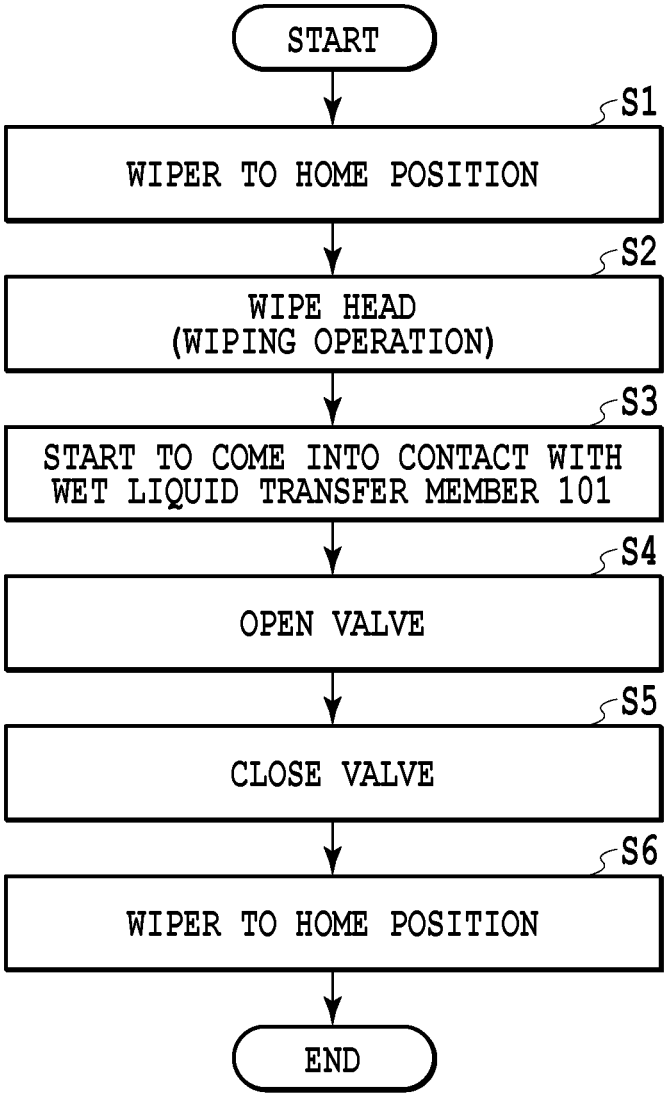
FIG. 15 is a flowchart of a wiping operation by using a wiper including an opening/closing operation of a valve.

FIG. 15 is a flowchart of a wiping operation by the wipers including the opening/closing operation of the wet liquid flow passage valve 103*b*. Hereinafter, a description will be given of the wiping operation by the wiper including the opening/closing timing of the wet liquid flow passage valve 103*b* with reference to the flowchart. In step S1, the wiper is arranged at a home position. After that, in step S2, the print head is wiped by the wipers 10A and 10B. Next, in step S3, the wipers 10A and 10B come into contact with the wet liquid transfer member 101.

Then, in step S4, the wipers 10A and 10B are operated and the wet liquid flow passage valve 103*b* is opened by pressing a shaft 202. After the wiping by the wipers, in order to solve the problem, as soon as possible, of the reverse flow into the ejection port of the remaining ink without being wiped by wiping, near the ejection port of the print head, it is necessary to perform an operation for ejecting the ink on a cap (not shown) arranged under the wiper. Therefore, the wiper needs to be returned to the home position immediately, and thus, after movement of the print head from above the wiper, the wet liquid flow passage valve 103*b* is closed in step S5, and the wiper is returned to the home position in step S6.

Figure 16:
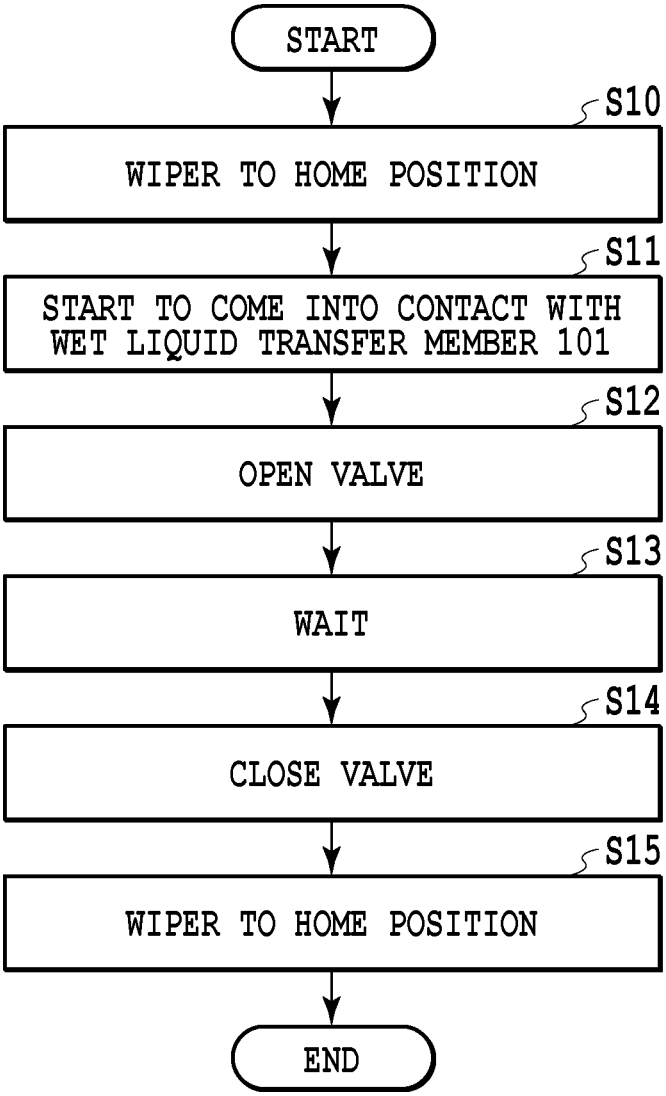
FIG. 16 is a flowchart of the opening/closing operation of the valve and contact between the wiper and a transfer member.

FIG. 16 is a flowchart in a case where the wiper comes into contact with the wet liquid transfer member 101 and performs the opening/closing operation of the wet liquid flow passage valve 103*b*. Hereinafter, with reference to the flowchart, a description will be given of the contact of the wiper with the wet liquid transfer member 101 and the opening/closing operation of the wet liquid flow passage valve 103*b*. Here, control order is shown at the time of opening/closing operation of the valve without the wiping operation. In step S10, the wiper is arranged at the home position. Subsequently, in step S11, the wipers 10A and 10B comes into contact with the wet liquid transfer member 101. In addition, in step S12, the wipers 10A and 10B are operated to press the shaft 202, thereby opening the wet liquid flow passage valve 103*b*.

After opening the wet liquid flow passage valve 103*b*, in step S13, the operation is waited in order to maintain the opening state for a predetermined time. The waiting time is determined corresponding to a required time for supplying the wet liquid in a low-temperature state. After that, in step S14, the wet liquid flow passage valve 103*b* is closed, and in step S15, the wiper is returned to the home position. Note that the opening/closing operation of the valve without the wiping operation may be performed at any timing other than the wiping operation.

In the flowchart shown in FIG. 15, in order to suppress the reverse flow to the ejection port of the ink without being wiped, the control for closing the wet liquid supply valve is performed without setting the waiting time after opening the wet liquid supply valve. However, this does not apply in a case where the influence of reverse-flowed ink on image formation is small. Namely, the waiting time maybe set after the wiping operation. Hereinafter, a description will be given of the wiping operation by the wiper including the opening/closing operation of the wet liquid flow passage valve 103*b* in a case where influence of the reverse-flowed ink on the image formation is small and ignorable.

Figure 17:
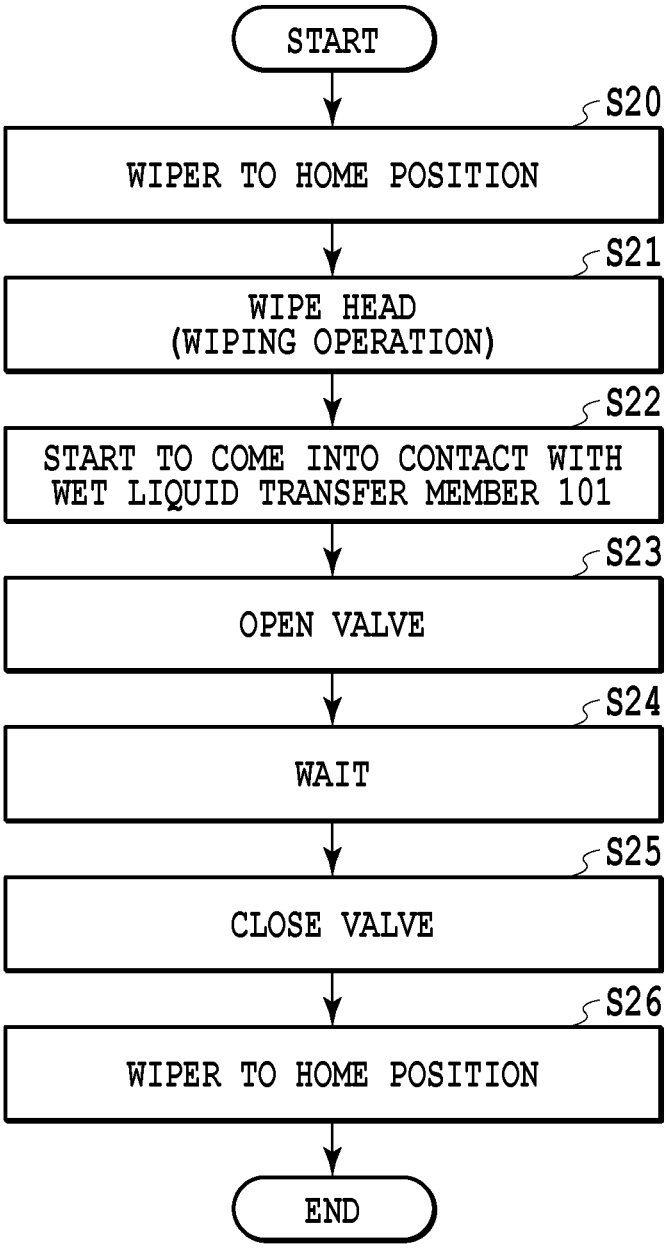
FIG. 17 is a flowchart of the wiping operation by the wiper.

FIG. 17 is a flowchart of a wiping operation by the wiper in a case where the influence of the reverse-flowed ink on the image formation is small. In step S20, the wiper is arranged at the home position. After that, in step S21, the wipers 10A and 10B wipe the print head. Next, in step S22, the wipers 10A and 10B make contact with the wet liquid transfer member 101. Then, in step S23, the wipers 10A and 10B are operated and the shaft 202 is pressed, thereby opening the wet liquid flow passage valve 103*b*. After opening the wet liquid flow passage valve 103*b*, in step S24, the operation is waited in order to maintain the opening state for a predetermined time. Subsequently, in step S25, the wet liquid flow passage valve 103*b* is closed, and in step S26, the wiper is returned to the home position.

As mentioned above, the valve that can change the volume is provided between the intermediate tank and the storing unit that stores the wet liquid and supplies the wet liquid to the intermediate tank, and the operation is waited for a predetermined time after opening the valve. Therefore, it has been possible to realize the print device including the wet liquid supply unit corresponding to a wider environmental range with a simple and inexpensive configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-194153 filed Sep. 30, 2015, which is hereby incorporated by reference wherein in its entirety.

What is claimed is:

1. A print device comprising:

a first liquid storing unit configured to store liquid;

a second liquid storing unit configured to store the liquid supplied from the first liquid storing unit;

a liquid flow passage for supplying the liquid from the first liquid storing unit to the second liquid storing unit;

an air flow passage for supplying air from the second liquid storing unit to the first liquid storing unit;

a flow suppressing unit configured to suppress a flow of the liquid from the second liquid storing unit to the first liquid storing unit in the liquid flow passage;

an air flow passage valve provided in the air flow passage and configured to switch between an open state in which air can be supplied from the second liquid storing unit to the first liquid storing unit, and a closed state in which air cannot be supplied from the second liquid storing unit to the first liquid storing unit; and a supplying unit configured to supply a liquid in the first liquid storing unit to the second liquid storing unit when the air flow passage valve is in the closed state.

2. The print device according to claim 1, wherein the supplying unit is provided in the liquid flow passage and is configured to change internal volume.

3. The print device according to claim 2, wherein in a case where the internal volume of the supplying unit is reduced in a state when the air flow passage valve is in the closed state, the liquid in the first liquid storing unit is supplied to the second liquid storing unit through the liquid flow passage.

4. The print device according to claim 3, wherein the supplying unit includes a first valve configured to shut off the liquid flow passage.

5. The print device according to claim 1, wherein the flow suppressing unit includes a liquid holding member configured to hold the liquid in the second liquid storing unit.

6. The print device according to claim 5, wherein the liquid holding member is formed by a porous body having air permeability.

7. The print device according to claim 6, wherein the liquid holding member is arranged adjacently to a first connecting unit between the second liquid storing unit and the liquid flow passage.

8. The print device according to claim 7, wherein a second connecting unit between the second liquid storing unit and the air flow passage is arranged at a position higher than that of the first connecting unit, and the liquid holding member is arranged in the second liquid storing unit not to be adjacent to the second connecting unit.

9. The print device according to claim 1, wherein the second liquid storing unit includes a supply unit configured to supply the liquid outside the second liquid storing unit.

10. The print device according to claim 9, further comprising:

a wiper configured to suck the liquid and to wipe a member, wherein the supply unit supplies the liquid to the wiper.

11. The print device according to claim 10, further comprising:

a driving unit configured to drive the wiper, wherein at least one of the first valve and the air flow passage valve performs an opening/closing operation by using the driving unit.

12. The print device according to claim 11, wherein the first valve and the air flow passage valve are simultaneously maintained in an opening state by using the driving unit.

13. The print device according to claim 12, wherein a driving timing of the driving unit is different between the wiper, and the first valve and the air flow passage valve.

14. The print device according to claim 10, further comprising:

a print head configured to perform a print operation, wherein the wiper wipes the print head.

15. The print device according to claim 14, further comprising:

a print head having an ejection port surface on which an ejection port for ejecting ink is provided;

the wiper for wiping the ejection port surface; and an applying unit configured to apply the liquid in the second liquid storing unit to the wiper by being in contact with the wiper.

16. The print device according to claim 1, wherein the first liquid storing unit is arranged at a position higher than that of the second liquid storing unit, and the liquid is supplied by the supplying unit from the first liquid storing unit to the second liquid storing unit, by a water head difference.

17. The print device according to claim 1, wherein the flow suppressing unit includes a check valve that is provided in the liquid flow passage, allows movement of the liquid from the first liquid storing unit to the second liquid storing unit, and suppresses the movement of the liquid in a reverse direction.

* * * * *